US005190278A

United States Patent [19]

Wallin et al.

[11] Patent Number: 5,190,278

[45] Date of Patent: Mar. 2, 1993

[54] MAGAZINE FOR CONTAINER FORMING SHEETS OR THE LIKE ADJUSTABLE FOR PREDETERMINED SHEETSIZES

[75] Inventors: Kay Wallin; Ingmar Nilsson, both of Halmstad, Sweden

[73] Assignee: Sprinter System AB, Sweden

[21] Appl. No.: 689,803

[22] PCT Filed: Nov. 30, 1989

[86] PCT No.: PCT/SE89/00703

§ 371 Date: Jan. 21, 1991

§ 102(e) Date: Jan. 21, 1991

[87] PCT Pub. No.: WO90/06275

PCT Pub. Date: Jun. 14, 1990

[30] Foreign Application Priority Data

Nov. 30, 1988 [SE] Sweden ..... 8804329

[51] Int. Cl.[5] ..... B65H 1/00

[52] U.S. Cl. ..... 271/147; 271/171

[58] Field of Search ..... 271/145, 147, 149, 152, 271/171; 221/242; 493/120, 122, 123, 126

[56] References Cited

U.S. PATENT DOCUMENTS

| | | | |
|---|---|---|---|
| 2,642,285 | 6/1953 | Bake et al. | 271/149 |
| 3,101,654 | 8/1963 | Ullman | 493/122 |
| 4,040,340 | 8/1977 | Iijima | 493/162 |
| 4,061,081 | 12/1977 | Pinto et al. | 493/317 |
| 4,072,090 | 2/1978 | Heisler | 493/313 |
| 4,369,613 | 1/1983 | Gess | 493/478 |
| 4,605,393 | 8/1986 | Krieger et al. | 493/317 |
| 4,674,998 | 6/1987 | Benedicenti | 493/474 |
| 4,708,707 | 11/1987 | Koike et al. | 271/171 X |

FOREIGN PATENT DOCUMENTS

| | | |
|---|---|---|
| 0298435 | 1/1989 | European Pat. Off. . |
| 1183915 | 12/1964 | Fed. Rep. of Germany . |
| 2425482 | 12/1975 | Fed. Rep. of Germany . |
| 2615042 | 10/1977 | Fed. Rep. of Germany . |
| 349512 | 2/1972 | Sweden . |
| 424164 | 3/1980 | Sweden . |

*Primary Examiner*—David H. Bollinger

*Attorney, Agent, or Firm*—Ostrolenk, Faber, Gerb & Soffen

[57] ABSTRACT

An apparatus for automatically adjusting the dimensions of the carton blank magazine in a machine for forming carton blanks to select a variety of predetermined sized carton blank formats and for delivering the carton blanks to an exit of the machine. The apparatus includes a pair of movable side tool portions and a movable bottom tool portion for guiding a carton blank. A format selecting wheel corresponds to each of the tool portions and each format setting wheel includes a plurality of pins having a different length corresponding to one of the dimensions of a particular predetermined carton blank format. Each of the pins has a free end which engages a respective bottom or side tool portion to fix the portion in a position determined by the selected blank format. The apparatus further includes a bottom guide device for delivering the carton blank to the exit of the machine.

3 Claims, 1 Drawing Sheet

MAGAZINE FOR CONTAINER FORMING SHEETS OR THE LIKE ADJUSTABLE FOR PREDETERMINED SHEETSIZES

BACKGROUND OF THE INVENTION

1. Field of the Invention

The present invention relates to an adjustable magazine apparatus in a machine for forming box or carton blanks and the like, the magazine including bottom and lateral side guides movably adjustable for enabling the use of different size blank formats. The present invention further relates to means for advancing the blanks forward in the magazine toward the exit or delivery end. Related subject matter is set forth in copending U.S. application Ser. No. 07/689,760 filed May 29, 1991.

2. Description of the Related Art

A variety of types of feed means in magazines for feeding blanks are well known. However, these magazines have complicated arrangements for feeding the blanks forward. In addition, problems often arise when blanks become packed together at the delivery end of the machine. When this occurs the blanks stick one against the other, preventing one at a time conveyance to an erecting tool, resulting in machine downtime. Another problem with these types of magazines has been that different size magazines are required for different blank formats. Moreover, in the case where a magazine is adjustable for different blank formats, the adjustment is very time consuming and complicated.

SUMMARY OF THE INVENTION

The object of the present invention is to provide an apparatus whereby the adjustment of the magazine to different blank formats can be carried out very simply, and in which the disadvantages to be found in known magazines on the market have been eliminated. What is essentially distinguishing for the invention here is that the magazine tool details which carry the lateral and bottom guides are movably adjustable relative to each other with the aid of format setting wheels to suit a plurality of predetermined blank formats. The format setting wheels have the same number of pins as the number of desired formats. Each pin length corresponds to one of the dimensions of the predetermined blank format. The end surfaces of the pins are adapted for coaction with stops on the respective tool detail, to fix the detail in the position determined by the chosen format.

With the aid of the present invention, there has now been provided an apparatus in a magazine which, apart from its being simple and inexpensive to manufacture, fills its function in an excellent way. With the aid of the inventive apparatus, the magazine can now be automatically set for different blank formats simply by the operator turning format selection knobs which in turn actuate the format setting wheels to provide the predetermined setting, a suitable number of formats being catered for by each format selection wheel.

BRIEF DESCRIPTION OF THE DRAWINGS

The invention will now be described in more detail below with reference to the accompanying drawings, where.

DETAILED DESCRIPTION OF THE PREFERRED EMBODIMENT

Figure 1:
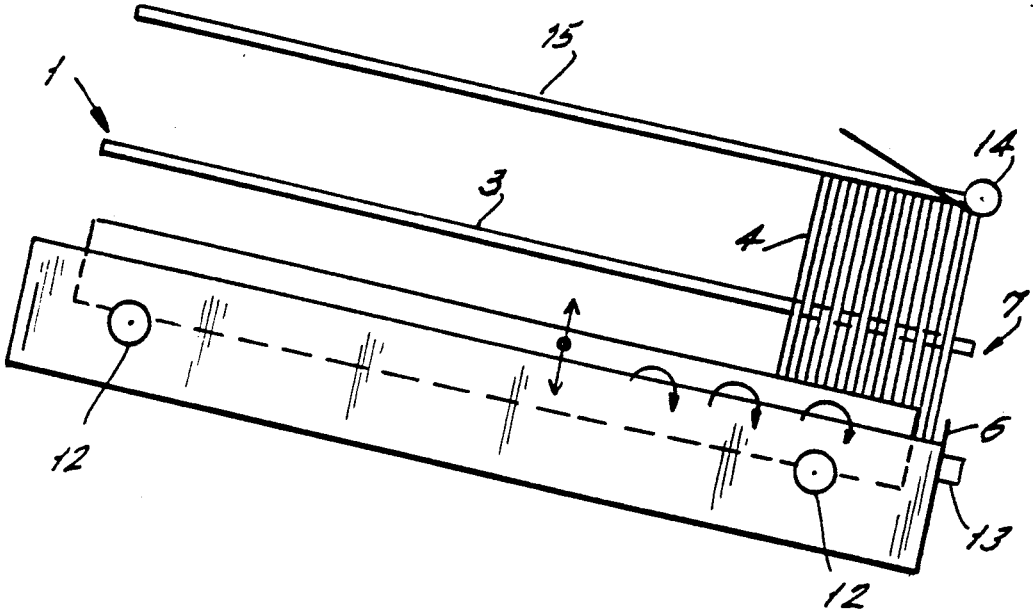
FIG. 1 is a schematic side view of a magazine in accordance with the present invention.

As will be seen from the drawings, the magazine 1 in the preferred embodiment of the present invention comprises bottom guides 2 and lateral guides 3 for blanks 4 arranged in the magazine 1. For advancing the blanks in the magazine 1 there is arranged at least one elongate means 5 between and closely adjacent the respective bottom guides 2. Means 5 is eccentrically mounted in the bottom guides 2 so as to temporarily project a short distance above the carrying surface of the bottom guides 2. This distance is sufficiently long enough to stepwise advance the blanks 4 into engagement with an end stop 6 at the delivery end 7 of the magazine 1. Driving the eccentrically mounted elongate means 5 is a motor 8 and shaft 9. The shaft 9 is provided with wheels 12 fixed thereon, the wheels being in turn provided with fixed short shaft 11. The projecting parts of the shafts are mounted in bearings 10 on the elongate means 5.

In connection with the end stop 6 there is a contact breaker, preferably in the form of a photo cell 13 arranged to sense when a predetermined number of blanks 4 are in the region of the exit or delivery end 7 of the magazine 1. Upon detection of the predetermined number there occurs a temporary interruption of the forward feed for the time it takes for a blank picker to take for example 5–10 blanks 4 from the magazine 1, so that packing of the blanks against the end stop 6 is avoided. When the predetermined number of blanks has been removed, feed-in is automatically started again until the predetermined number of blanks has collected in the exit region. A rotatable stop 14 can be arranged at the upper edge of the exit of the magazine 1 to facilitate removal of the blanks from the magazine. In addition, upper guides 15 can be arranged above the blanks in the longitudinal direction of the magazine.

Figure 2:
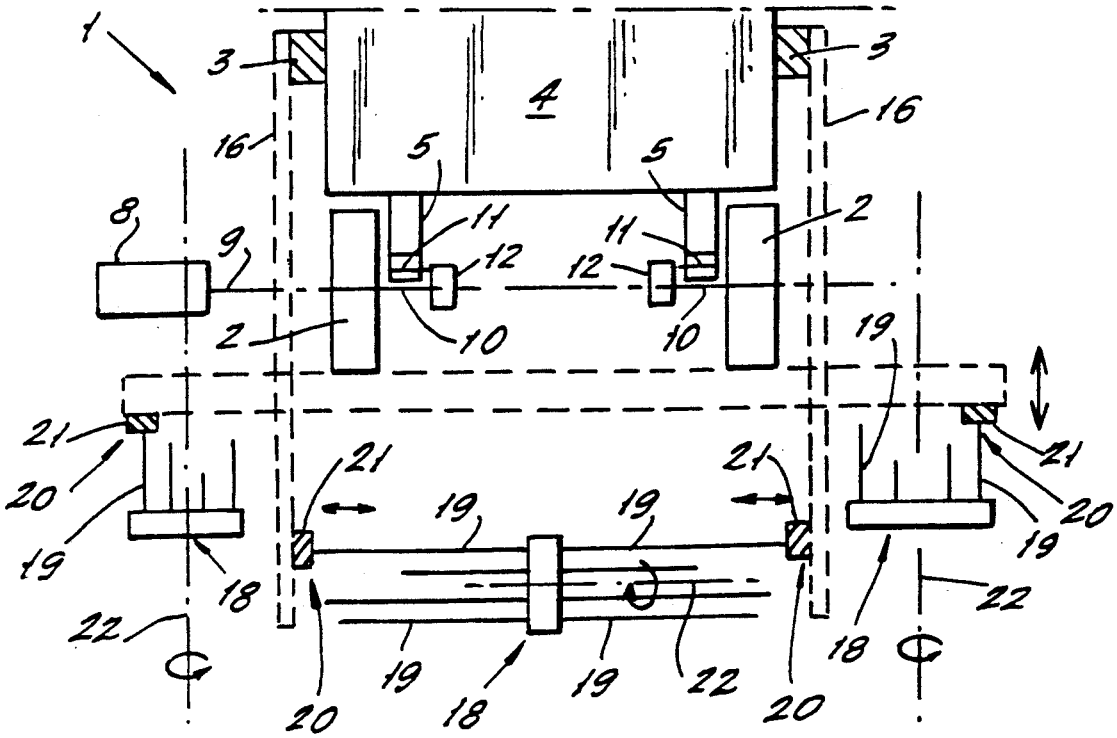
FIG. 2 is an end view of the magazine illustrated in FIG. 1.

As will be seen from FIG. 2, the magazine can be set for different size blank formats. The tool details 16 carrying the lateral guides 3 and the tool details 17 carrying the bottom guides 2 can be moved into suitably related settings with the aid of format setting wheels 18. As described above, each format setting wheel has a plurality of pins 19 formed perpendicular thereto. Each pin has a different length corresponding to a dimension of a predetermined blank format. Pins 19 are arranged such that their free end surfaces 20 coact with stops 21 provided on the respective tool details 16, 17. Movement of the tool details 16, 17 takes place with the aid of drive cylinders, not illustrated in the drawings. Setting of a desired blank format takes place when the respective tool detail is in a position corresponding to its largest format dimension, or starting position, which enables its format setting wheel 18 to be turned to the position corresponding to the desired blank format if necessary. Turning the format setting wheels 18 can be accomplished by using format selection knobs, not illustrated in the drawings, which are arranged in visible and accessible positions on the device. Rotation of the format setting wheels 18 can be actuated with the aid of shafts 22. A suitable number of pins 19 can for example, be 6–8 pins on each format setting wheel 18.

Although the present invention has been described in relation to a particular embodiment, many other variations and modifications and other uses will be apparent to those skilled in the art. It is preferred, therefore, that the present invention be limited not only to the specific disclosure herein, but only by the appended claims.

We claim:

1. An apparatus for automatically adjusting the dimensions of a carton blank magazine in a machine for forming carton blanks to select a plurality of predetermined sized carton blank formats, and for delivering the carton blanks to an exit of the machine, the apparatus comprising:

a selectively movable bottom tool portion;

a pair of selectively movable side tool portions;

bottom guide means disposed on said bottom tool portion for vertically guiding a carton blank;

at least one side guide means disposed on each of said side tool portions for horizontally guiding the carton blank;

a step disposed on each of said bottom and side tool portions;

a format setting wheel associated with each of said bottom and side tool portions, each format setting wheel including a plurality of pins extending perpendicularly therethrough, each of said pins having a different length corresponding to one of the dimensions of a particular predetermined carton blank format;

each of said pins including a free end which engages the stop of a respective bottom or side tool portion, whereby when said free end engages a stop, the respective bottom or side portion is fixed in a position determined by the selected blank format; and advancing means disposed on said bottom guide means for delivering the carton blanks to the end of the machine.

2. The apparatus of claim 1, further comprising detecting means disposed at the exit of the machine for sensing when a predetermined number of carton blanks have been delivered to the end of the machine and for temporarily interrupting said advancing means until the predetermined number of carton blanks have been removed from the machine.

3. The apparatus of claim 1, wherein each format setting wheel includes six to eight pins which correspond to six to eight carton blank formats.

* * * * *